US006266850B1

(12) United States Patent
Williams et al.

(10) Patent No.: US 6,266,850 B1
(45) **Date of Patent: *Jul. 31, 2001**

(54) HAND-HELD TOOL AND ADJUSTABLE HANDLE FOR SAME

(75) Inventors: Kevin Williams; Marco Perry, both of Brooklyn, NY (US)

(73) Assignee: Interdynamics, Inc., Brooklyn, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/293,393

(22) Filed: Apr. 16, 1999

(51) Int. Cl.[7] ..... B25G 3/00

(52) U.S. Cl. ..... 16/430; 16/900; 409/182; 144/136.95; 403/97

(58) Field of Search ..... 16/430, 436, 438, 16/445, 900, 324–328, 329; 409/182; 144/136.95, 154.5; 403/97, 99; 74/548, 544, 546, 547; 108/71, 72, 73; 248/918

(56) References Cited

U.S. PATENT DOCUMENTS 1,874,232 * 8/1932 Groene et al. ..... 409/182
3,986,409 * 10/1976 Tripp ..... 74/548
4,186,905 * 2/1980 Brudy ..... 403/97
4,239,428 * 12/1980 Berzina ..... 409/182
4,938,642 * 7/1990 Imahashi et al. ..... 409/182
5,062,179 * 11/1991 Huang ..... 16/430
5,154,435 * 10/1992 Chiu ..... 403/97
5,168,601 * 12/1992 Liu ..... 16/445
5,371,919 * 12/1994 Winkler ..... 16/422
5,775,657 * 7/1998 Hung ..... 248/918
5,806,453 * 9/1998 Cook ..... 114/230

* cited by examiner

*Primary Examiner*—Chuck Y. Mah
(74) *Attorney, Agent, or Firm*—Levisohn, Lerner, Berger & Langsam

(57) ABSTRACT

A hand-held tool having an adjustable grip is provided. The grip includes a handle moveable from a locked position to an unlocked position and a clutch mechanism engageable with the handle when the handle is in the locked position. The clutch mechanism prevents the handle from being repositioned when the handle is in the locked position and allows the handle to be repositioned relative to the tool when the handle is in the unlocked position. A shaft is rotatably disposed through a socket in the housing, and a cog may be disposed on a first end of the shaft, selectively engageable with the socket. When the shaft is in a first position, the cog engages the socket and the shaft may not be rotated, and when the shaft is in a second position, the cog does not engage the socket and the shaft may be freely rotated within the socket. A handle is disposed on a free end of the shaft. In the first position, the shaft is locked into one of a number of rotational positions with respect to the housing; in the second position, the rotational position of the shaft may be changed. Alternatively, instead of a cog and teeth, two friction elements may be provided. In this way, the angle of the handle with respect to the hand-held tool may be altered for safety and convenience.

35 Claims, 9 Drawing Sheets

HAND-HELD TOOL AND ADJUSTABLE HANDLE FOR SAME

BACKGROUND OF THE INVENTION

1. Field of the Invention

This invention relates to tools, and more particularly to tools hand-held by a user, such as waxer-buffers, that may be made more ergonomically correct.

2. Description of the Related Art

Hand-held tools have been in use for a long time. It is common to use a router or an orbital sander on a flat plane which is parallel to the floor of a work area. Typically, if a board needs to be sanded or routed, the board is laid flat on a table, two saw horses, or the like, and the tool is used on the board. It is also common to use tools such as a waxer-buffer on relatively flat planar surfaces like the hood of an automobile. This type of tool requires substantially complete surface-to-surface contact between the working surface of the tool and the to-be-worked surface. For example, when using a waxer-buffer or an orbital sander, it is undesirable for there to be any appreciable angle between the two surfaces; if only the edges of the tool contact the surface, the resulting waxing, buffing, or sanding is uneven, and the to-be-worked surface could be damaged. Thus, it is convenient to be able to lay a to-be-worked surface flat on a table so that complete surface-to-surface contact may be made and maintained.

However, it is common to be in a situation where it is impossible to lay the to-be-worked surface down flat on a table. For example, the side doors of an automobile or the hull of a boat cannot be moved or re-oriented in any fashion. Similarly, if a wall of a room requires sanding or the like, it, too, cannot be re-oriented. One must orient the tool to contact such a surface completely and properly. When one re-orients a hand-held tool, the handles of the tool are typically oriented at an uncomfortable or inconvenient angle, because the handles are typically fixed with respect to the rest of the tool. Consequently, it is often difficult to hold a hand-held tool at an angle for any length of time. As a result, one is more likely to drop a hand-held tool in such an orientation, resulting in damage to the tool and the to-be-worked surface and risk of injury to the user.

SUMMARY OF THE INVENTION

Accordingly, it is an object of the invention to provide a new handle or grip mechanism for a hand-held tool with which it is easier to maintain full surface-to-surface contact between the tool and the to-be-worked surface.

It is another object of the invention to provide a new handle or grip mechanism for a hand-held tool that is ergonomically correct and that will allow for the ergonomically correct use of the tool.

It is another object of the invention to provide a new handle or grip mechanism for a hand-held tool that is more comfortable to use.

It is another object of the invention to provide an adjustable handle or grip mechanism for a power tool.

It is another object of the invention to provide a hand-held tool that is ergonomically correct and that will allow for the ergonomically correct use of the tool.

It is another object of the invention to provide a hand-held tool having an adjustable handle or grip mechanism.

It is another object of the invention to provide an adjustable handle or grip mechanism for a hand-held tool to enable the tool to be used easily on surfaces that are not parallel with the floor.

The above and other objects are fulfilled by the invention, which is a holding or gripping mechanism for a hand-held tool. The invention also includes a hand-held tool having this adjustable holding or gripping mechanism. The invention includes a handle moveable from a locked position to an unlocked position and a clutch mechanism engageable with the handle when the handle is in the locked position. The clutch mechanism prevents the handle from being repositioned when the handle is in the locked position and allows the handle to be repositioned relative to the tool when the handle is in the unlocked position.

In a preferred embodiment, the clutch mechanism includes a socket formed through the housing of the tool, and a shaft, rotatably disposed through the socket. A cog may be provided on a first end of the shaft selectively engageable with the socket. Alternatively, the first end of the shaft in the socket may itself be provided with teeth and act like a cog to make the shaft selectively engageable with teeth in the socket. When the shaft is in a first axial locked position, the cog (or shaft teeth) engages the socket and the shaft may not be rotated, and when the shaft is in a second position, the cog does not engage the socket and the shaft may be freely rotated within the socket. Alternatively, friction plates may be employed instead of the cog and teeth embodiment described above. A spring is provided in contact with the shaft, biasing the shaft axially into one of the first and second axial positions, preferably into the first locked position.

In the first position, the shaft is locked into one of a number of rotational positions with respect to the housing; in the second position, the rotational position of the shaft may be changed. In this way, the angle of the handle with respect to the tool may be altered for safety and convenience. Thus, if the user must sand or wax a boat hull, for example, he may push the handles of the tool from the first locked position to the second unlocked position wherein they are free to rotate with respect to the tool. The user then rotates the handles into a comfortable position and releases the handles. The spring-biased handles return to the first locked position axially, however their rotational positions have been altered to a more comfortable position. In the cog and teeth embodiment, the handle may be moved into a number of discrete positions. In the friction plate embodiment, the handle may be moved through a continuous range of positions.

Preferably, in either embodiment, the two mating elements are tapered and disposed in an at least partially nested configuration. In such an arrangement, the elements may be more easily disengaged from each other without requiring the inner element to be moved completely out of the confines of the outer element.

DETAILED DESCRIPTION OF THE PREFERRED EMBODIMENT

Figure 1:
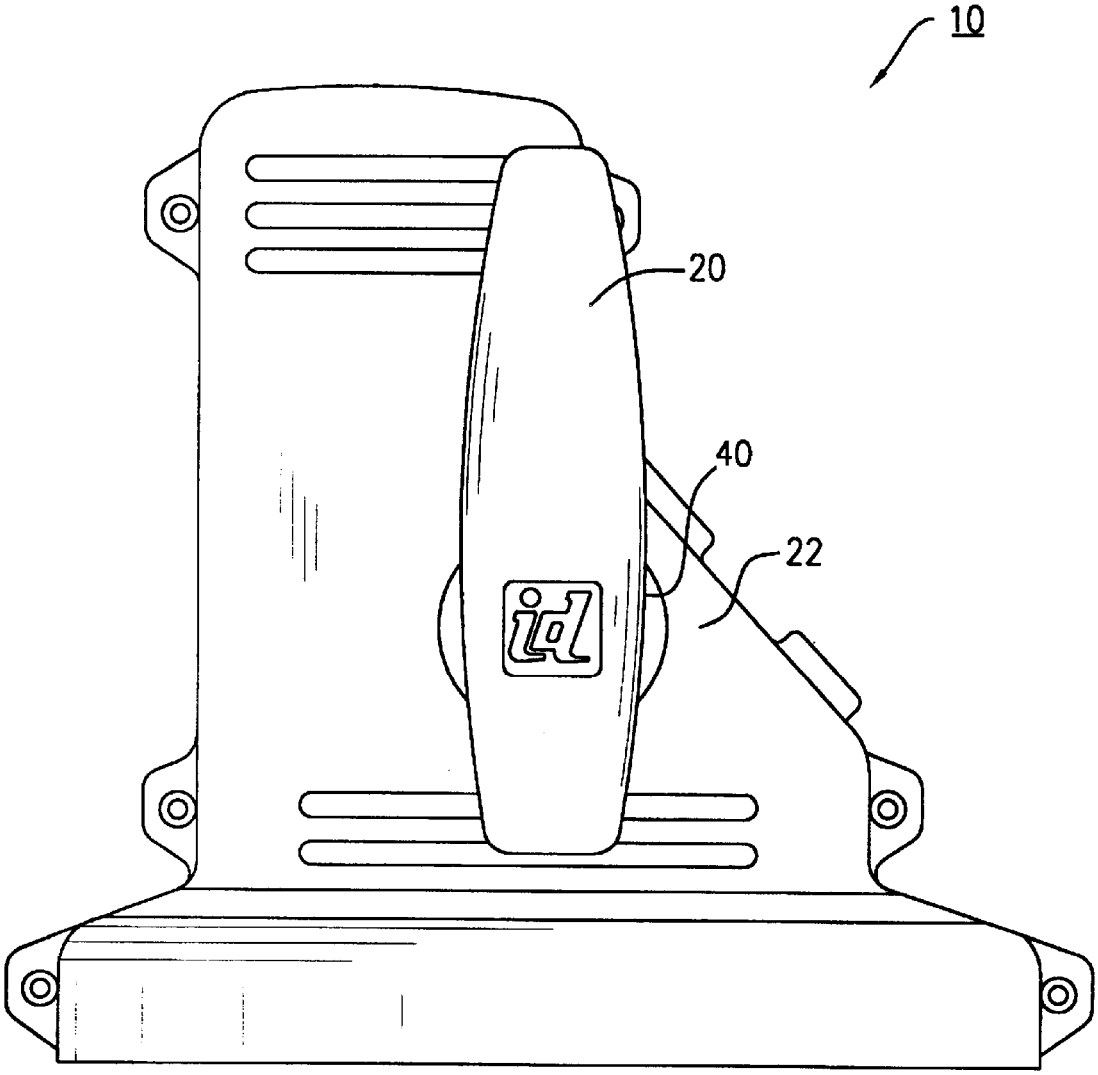
FIG. 1 is a side perspective view of a hand-held tool according to the invention.
Figure 2:
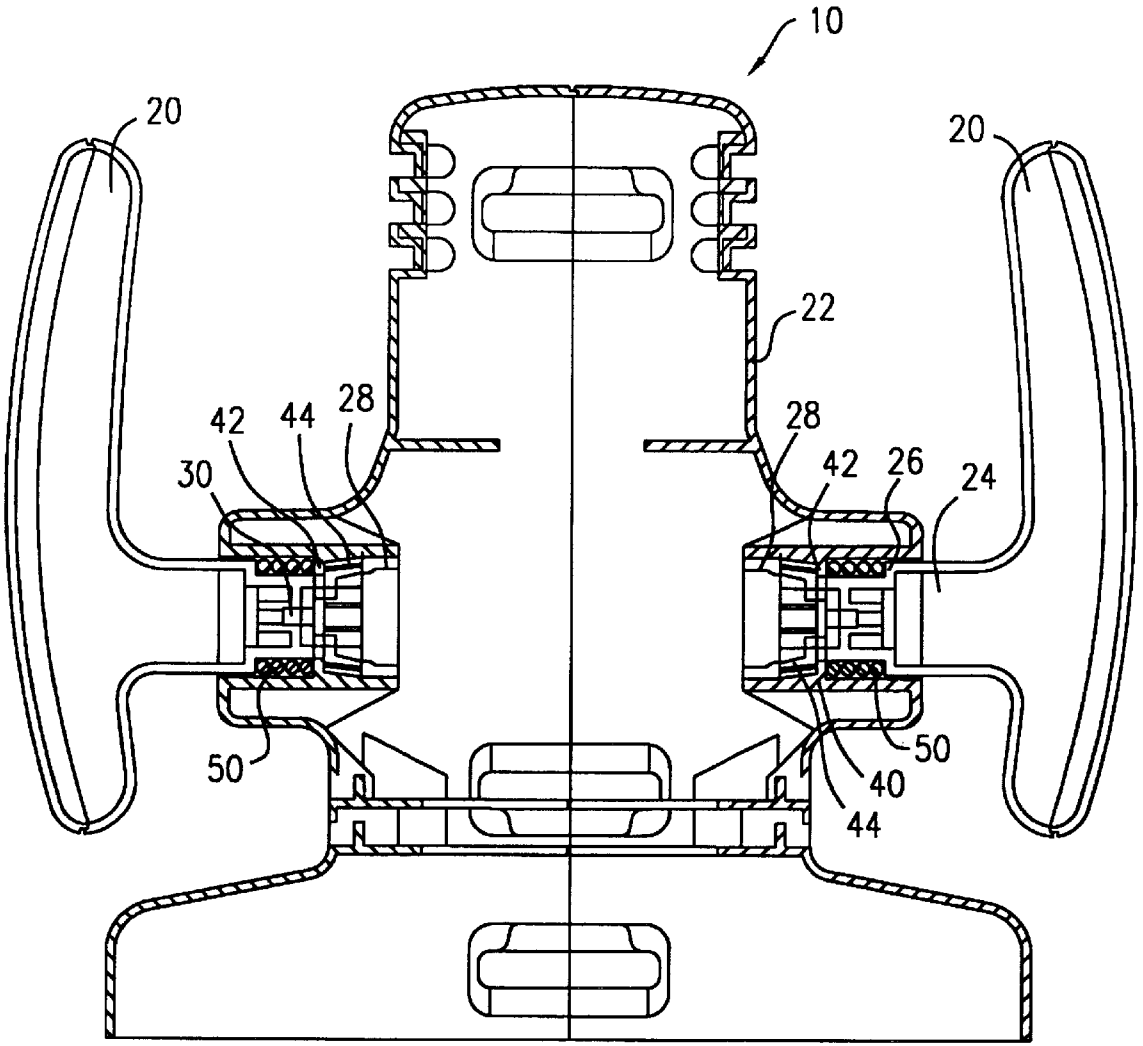
FIG. 2 is a front sectional view of a hand-held tool according to the invention.
Figure 3:
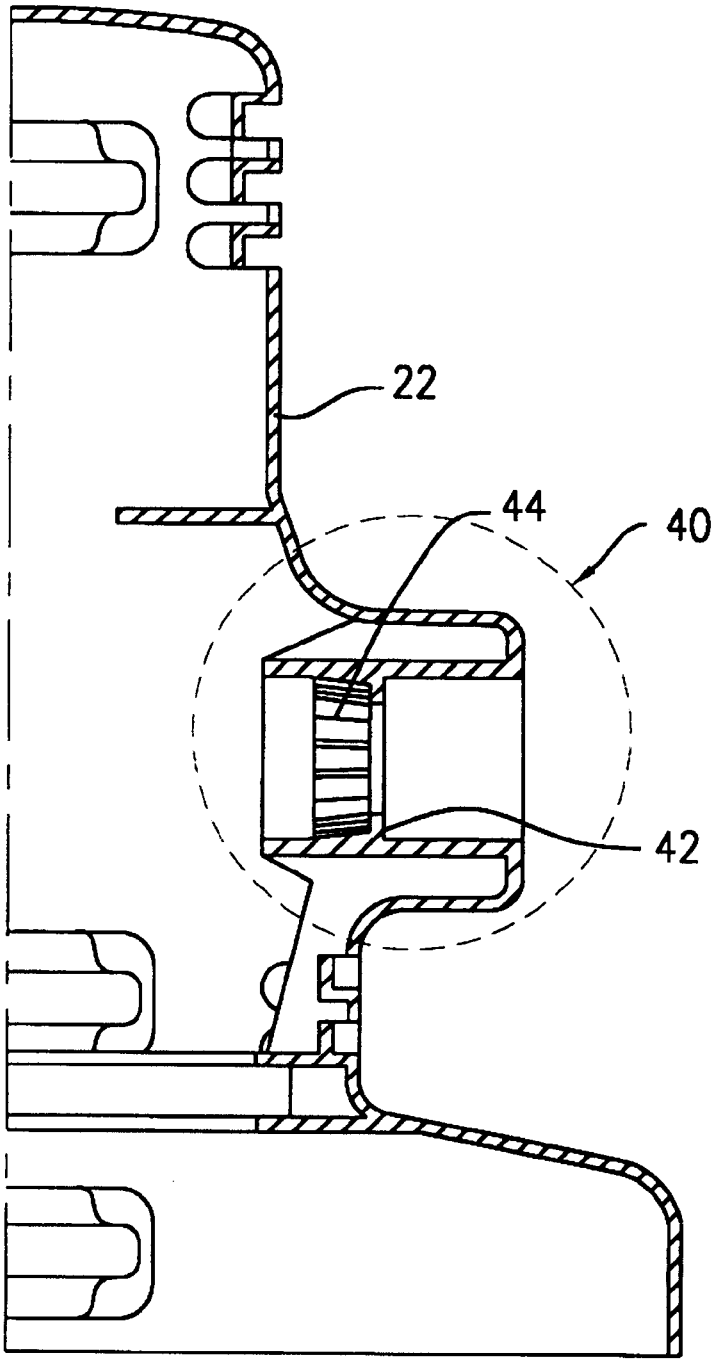
FIG. 3 is a front sectional view of half of the housing of the hand-held tool of FIG. 2.

Description will now be given of the invention with reference to FIGS. 1–7B. FIGS. 1–3 illustrate a waxer-buffer 10 having the inventive adjustable handle mechanism. However, it is to be understood that the waxer-buffer is merely depicted for illustrative and exemplary purposes only; the invention is not so limited and incorporates any known hand-held tool, such as (but not limited to an orbital sander, a router, a power saw, and the like.

As shown in FIG. 1, waxer-buffer 10 includes a handle 20 and a housing 22. Housing 22 is provided with a socket 40 to which handle 20 is attached. The motor and other electrical parts of buffer 10 are conventional and are not discussed here.

FIG. 2 offers a sectional view of the housing 22 and the handle 20 of buffer 10. Shaft 24 is disposed in socket 40 of housing 22. One end of shaft 24 is disposed inside housing 22, and the other end protrudes outside housing 22. Handle 20 is mounted on the free outer end of shaft 24. Shaft 24 is provided with a flange 26, the purpose of which will become clear below. A cog 28 is attached to the inner end of shaft 24 via a screw or bolt 30 and is provided with splines or teeth 29 (see FIG. 4).

Socket 40 is provided with a flange 42 approximately mid-way through socket 40 (also see FIG. 3). On the interior side of flange 42, socket 40 is provided with splines or teeth 44. Teeth 29 of cog 28 are adapted to be engageable with teeth 44. Biasing spring 50 abuts against flange 42 of socket 40 and flange 26 of shaft 24 to push the shaft and handle in an outward direction from housing 22 and to pull teeth 29 of cog 28 into meshing engagement with teeth 44 of socket 40. Because spring 50 biases cog teeth 29 into socket teeth 44, the handle 20 cannot be rotated about the longitudinal axis of shaft 24; in this position, the handle is locked in place. However, if a user were to push the handle 20 towards the housing 22, thus overcoming the biasing force of spring 50, cog teeth 29 and socket teeth 44 would not meshingly engage each other, and the handle 22 would be free to rotate around the longitudinal axis of shaft 24; in this position, the handle is adjustable. It is preferred that spring 50 naturally bias shaft 24 and handle 20 into the locked position so that the handles of the tool will not rotate freely during use.

Figure 4:
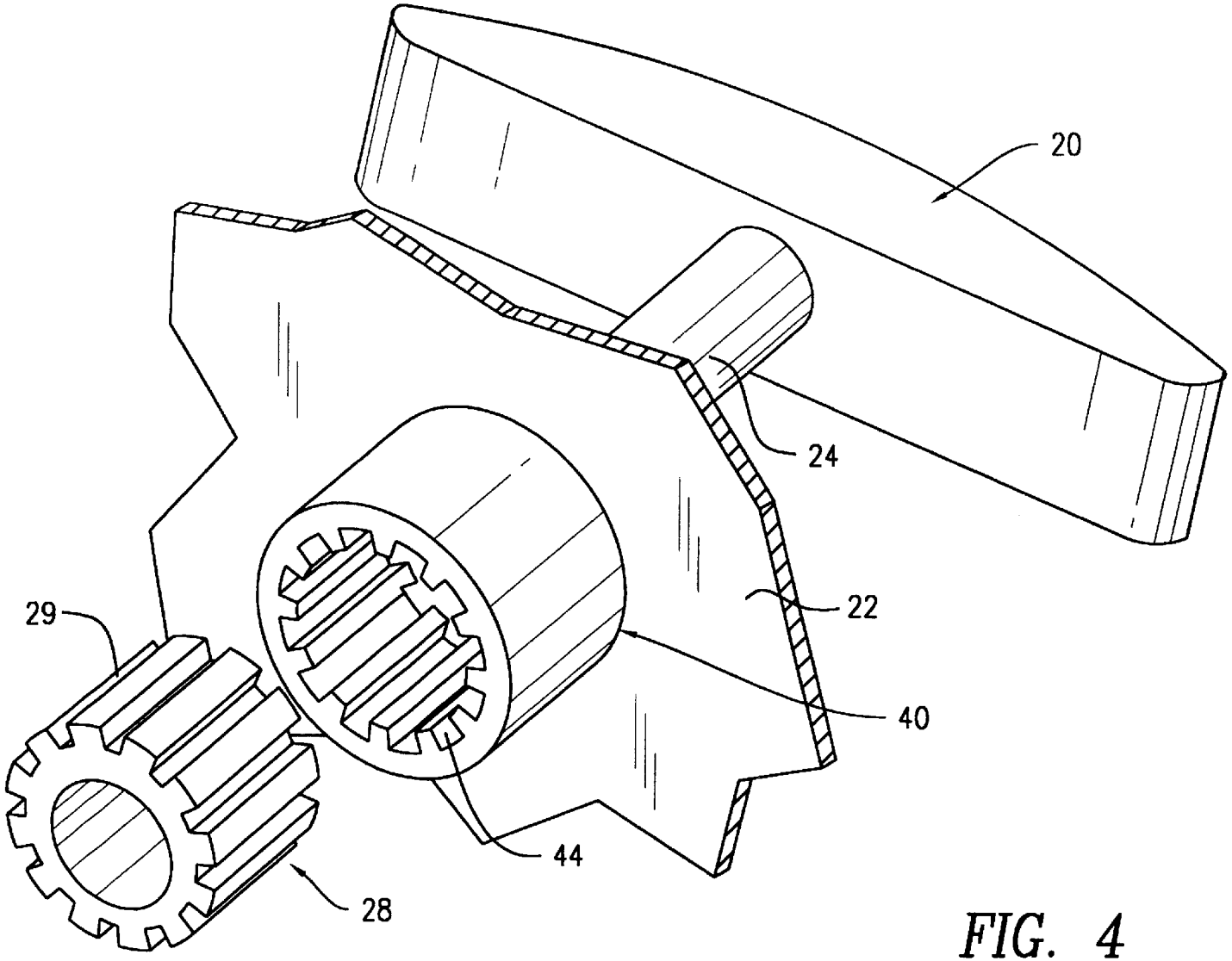
FIG. 4 is an exploded perspective schematic view of a handle mechanism according to the invention.
Figure 5A:
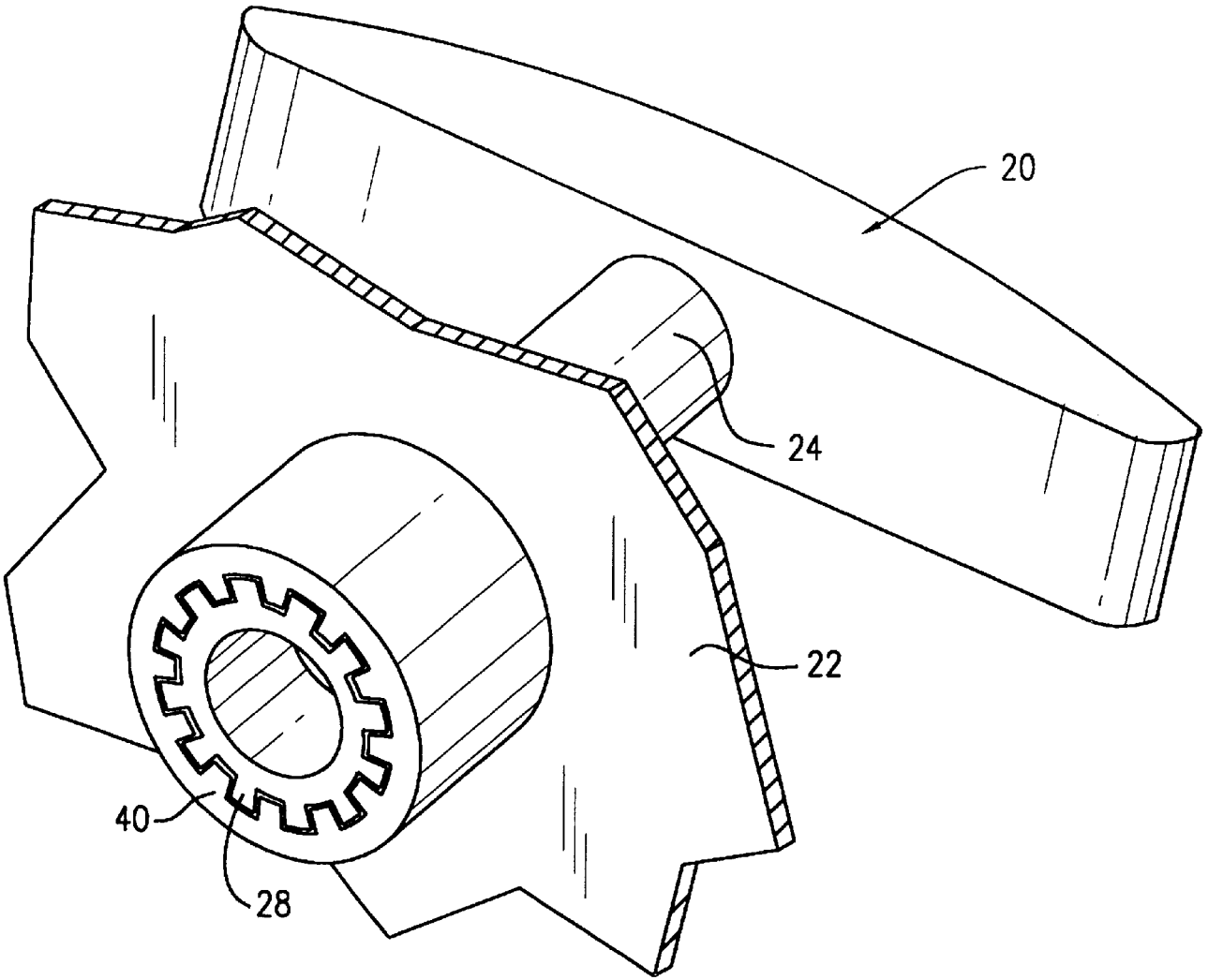
FIGS. 5A–D are perspective schematic views of the handle mechanism of FIG. 4 being moved from a first locked position to a second unlocked position, rotated axially, and moved back to a first locked position.
Figure 5B:
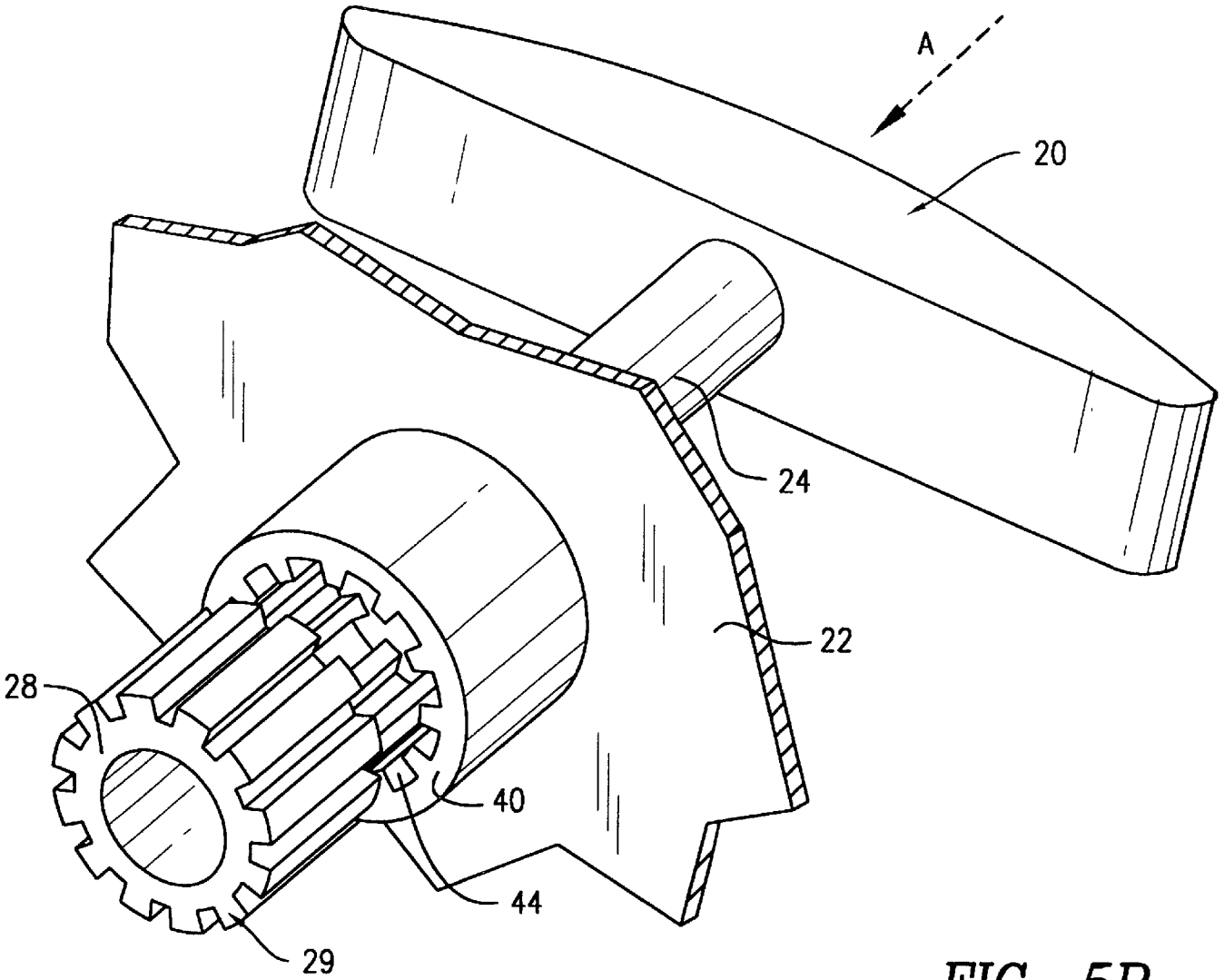
Figure 5C:
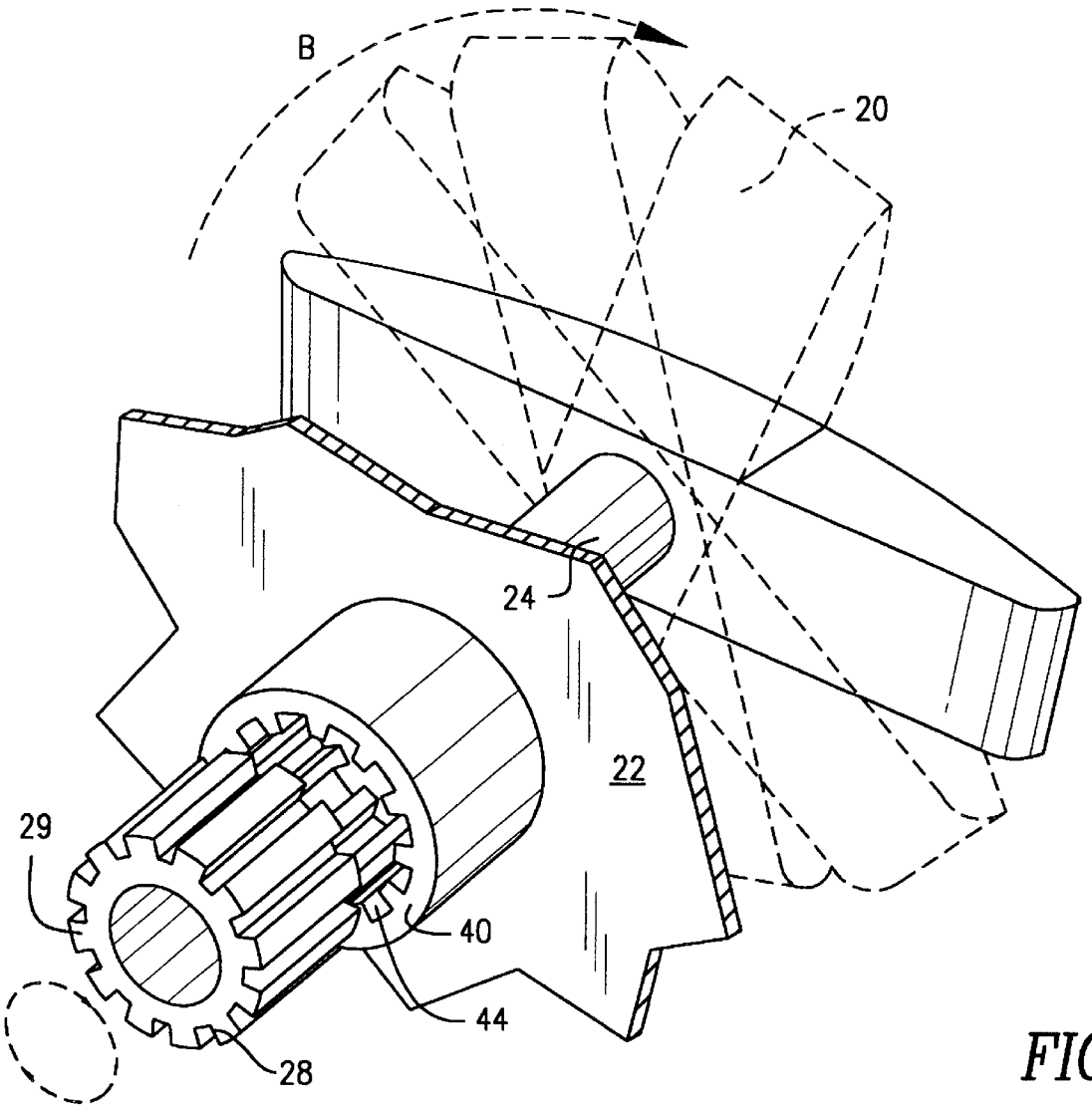
Figure 5D:
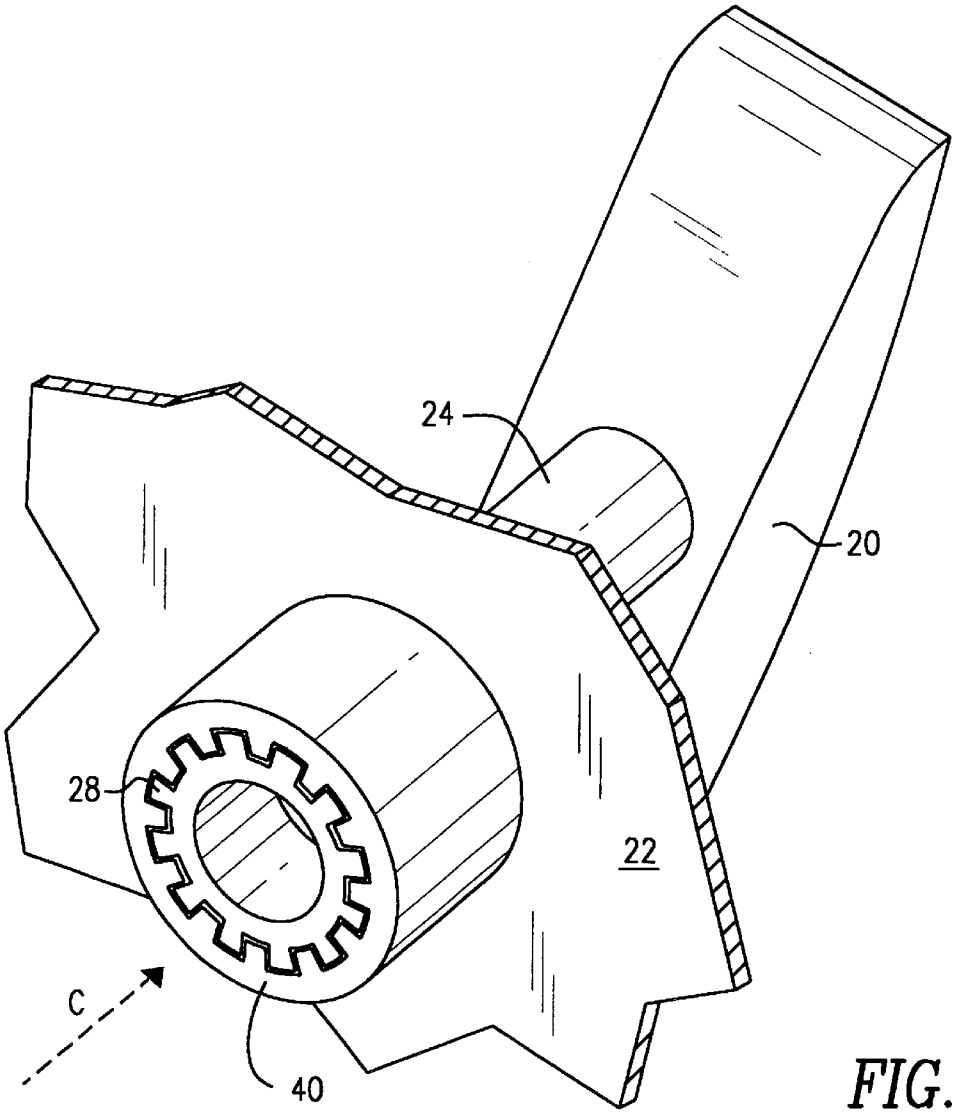

The adjustable handle mechanism of the preferred embodiment is shown in FIG. 4, the use of the adjustable feature is shown in FIGS. 5A–D. First, as shown in FIG. 5A, shaft 24 and handle 20 are locked in place with respect to housing 22, owing to cog teeth 29 engaging socket teeth 44. If the user wishes to change the orientation of handle 20, he must push or depress handle 20 towards housing 22, in the direction of arrow A in FIG. 5B. By doing so, the user overcomes the biasing force of spring 50 and pushes cog 28 out of alignment with socket 40, and thus disengages cog teeth 29 from socket teeth 44. Next, while handle 20 is still depressed towards housing 22, the user may rotate the handle 20, as shown in FIG. 5C by arrow B, until handle 20 is in the desired orientation. Finally, once the handle has been moved into the desired orientation, the user releases the handle 20 and allows spring 50 to bias shaft 24 back to the original locked position, as shown in FIG. 5D by arrow C. Cog teeth 29 and socket teeth 44 are once again engaged and the handle is now locked in a different position that is more convenient, comfortable, and ergonomically correct for the user.

In the preferred embodiment, as shown in FIGS. 2 and 3, teeth 44 of socket 40 and cog 28 are slightly tapered. By tapering both socket 40 and cog 28, disengagement of the cog from the socket becomes easier and faster, because cog 28 need only be moved a short distance to disengage cog teeth 29 from socket teeth 44. If cog 28 and socket 40 were not tapered but fully cylindrical (as shown in FIGS. 4 and 5, for example), cog 28 would still engage socket 40 even if the cog were partially disposed outside the socket; only when the cog is fully outside the confines of socket 40 (see FIGS. 5B and C, for example) would their respective teeth disengage.

The above-described preferred embodiment enables the handle to be moved into one of a number of discrete positions because the teeth of the cog must engage with the teeth of the socket. However, in an alternate embodiment, the invention includes a clutch mechanism that offers infinitely variable positioning of the handle through a continuous range of positions. In the alternate embodiment, meshing teeth are not employed, but rather frictional elements are employed. The shaft 22 is provided with one frictional element, and the socket or housing is provided with another frictional element. As in the preferred embodiment, the two elements are biased together in the locked position; the user must overcome the biasing force to move the shaft 22 and handle 20 into the unlocked position, wherein the handle may be freely rotated and repositioned.

Figure 6A:
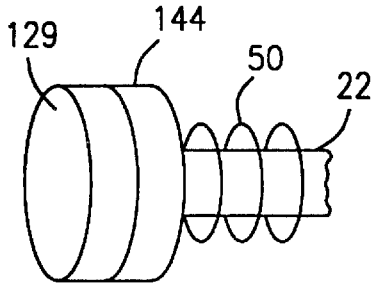
FIGS. 6A–B are side perspective views of an alternate embodiment of the clutch mechanism of the invention.
Figure 6B:
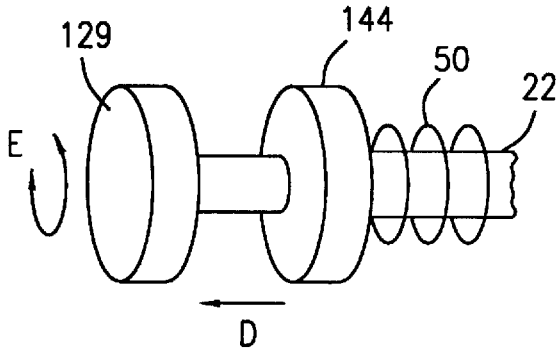
Figure 7A:
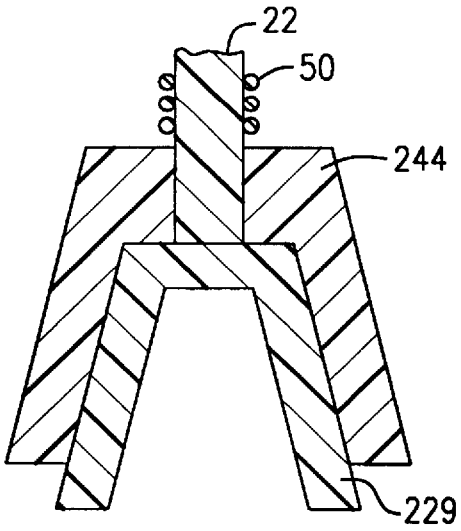
FIGS. 7A–B are side sectional views of a second alternate embodiment of the clutch mechanism of the invention.
Figure 7B:
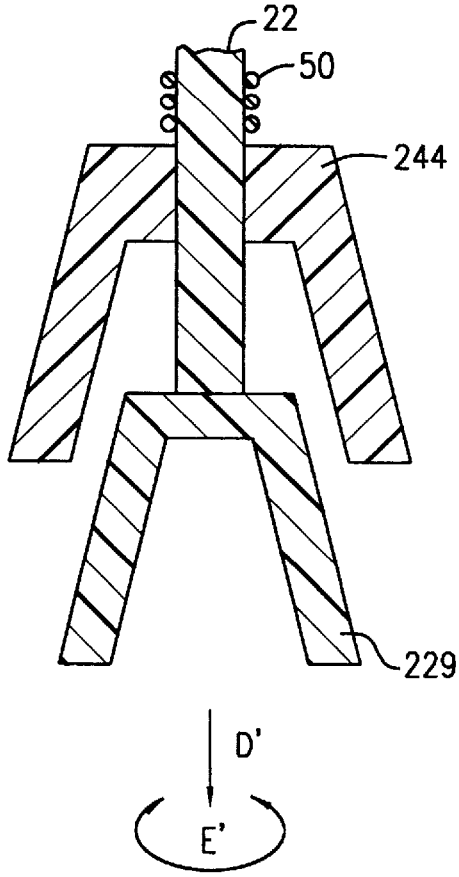

The alternate embodiment is depicted in FIGS. 6A–7B. In FIG. 6A, shaft 22 is provided with a friction plate 129, and the housing or socket is provided with a friction plate 144. Spring 50 biases the two friction plates together. Because of the high coefficient of friction between friction plates 129 and 144 and the biasing force of spring 50, when shaft 22 is in the locked position as shown in FIG. 6A, shaft 22 may not be rotated, and the handle is fixed relative to the tool. However, as shown in FIG. 6B, when the user pushes the handle inwards in the direction of arrow D, plate 129 moves away from plate 144, and there is no frictional resistance between the plates. Consequently, in the unlocked position as shown in FIG. 6B, the shaft 22 (and thus the handle) may be freely rotated as indicated by arrow E. FIGS. 7A–B depict a modified version of the friction element embodiment. Instead of plates, shaft 22 is provided with frictional cone 229, and the housing or socket is provided with a frictional cone 244. Again, because of the high coefficient of friction between cones 229 and 244, when the handle is in the locked position shown in FIG. 7A, shaft 22 and thus the handle is fixed. However, as shown in FIG. 7B, when the user pushes the handle inward as indicated by arrow D', cone 129 moves away from cone 144, and there is no frictional resistance between the cones. Consequently, in the unlocked position as shown in FIG. 7B, the shaft 22 (and thus the handle) may be freely rotated as indicated by arrow E'.

The invention is not limited to the description above but rather is determined by the appended claims. Variations on the invention are contemplated as being within the scope of the invention. For example, the drawings depict a waxer-buffer, however the inventive tool handle mechanism and tool having same is not so limited; it is to be understood by those skilled in the art that any hand-held tool having the inventive handle mechanism is contemplated as being within the scope of the invention. The invention, for example, includes orbital sanders, routers, and power saws, to name a few, and need not be limited to power tools. Further, although the housing is shown sectioned as metal, plastic or any other known material may be used for the housing, handle, and the like.

Similarly, although the frictional cones are shown as sectioned in plastic, any other material may be used. Also, the frictional elements are not limited in geometry to only plates, discs, or cones. Any convenient geometry of frictional element, with or without teeth or splines, may be employed and is contemplated as being within the scope of the invention. The geometry can be selected as a function of how easy or difficult it is to disengage the handle from a locked position. Should it be desired to construct a clutch mechanism having a very strong locking force to overcome, the two frictional elements may be shaped as cylinders and be provided with teeth. In such a construction, the inner cylinder would need to be pushed entirely out of the outer cylinder before the handle would be unlocked and free to rotate. As a result, the clutch mechanism is very strong and offers little chance of slipping, however it requires a great deal of force from the operator to unlock and reposition the handle. At the other end of the spectrum, in the embodiment of FIGS. 6A–B, for example, the friction plates 129 and 144 need only be separated by the smallest of distances in order to unlock the handle. As a result, the clutch mechanism is made very easy to unlock, however it may not provide a great deal of locking torque for when the handle is in a locked position. The tapered embodiments of FIGS. 2 and 3 and 7 fall somewhere in between the extremes of the cylindrical elements and the flat elements, and they provide both ease of operation in disengaging the clutch mechanism as well as adequate locking torque.

Other configurations of the clutch mechanism are also contemplated. For example, the flat discs of the FIG. 6 embodiment may be provided with mating sinusoidal profiles. The peaks of one disc would engage the valleys of the other disc, and vice versa. This sinusoidal design provides the benefits of a toothed arrangement—e.g., specific indexed handle positions—with the benefits of a frictional arrangement—e.g., ease of disengagement. Moreover, although the drawings depict the clutch mechanism being substantially internal to the housing of the tool, it is also within the scope of the invention to dispose the clutch mechanism either partially of wholly on the outside of the housing, for either the teeth and cog embodiment or the frictional element embodiment.

The invention is also not limited to a clutch mechanism having a spring biasing means; any means of biasing the frictional elements of FIGS. 6 and 7 together may be employed. For example, plates 129 and 144 or cones 229 and 244 may be magnetized so that they are naturally attracted together; only by the user exerting sufficient force to overcome the magnetic pull between them would he be able to move the handle into the second unlocked position. The magnetized embodiment of the frictional plates would be depicted exactly as depicted in FIGS. 6A–7B, except that spring 50 would be optional.

Finally, the above description states that the shaft and handle are biased into a locked or fixed position. However, it is not necessary that the handle in the locked position be absolutely immobile relative to the tool; if there is a minute amount of positional slippage of the handle when it is in the locked position, it would still be deemed to be "locked."

What is claimed is:

1. An adjustable grip of a hand-held tool having a housing, comprising:

a handle rotatably moveable from a locked position to an unlocked position; and a clutch mechanism selectively engageable with said handle when said handle is in said locked position and disengageable with said handle by application of axial force to said handle, said clutch mechanism preventing said handle from being repositioned when said handle is in said locked position and allowing said handle to be repositioned relative to the tool when said handle is in said unlocked position, said clutch mechanism spring-biasing said handle into said locked position, said clutch mechanism comprising:

a socket formed through the housing of the hand-held tool;

a shaft, rotatably disposed through said socket, said handle disposed on a first end of said shaft;

a cog, selectively engageable with said socket, disposed on a second end of said shaft; and a spring in contact with said shaft, said spring biasing said shaft and handle axially into said locked position, wherein when said shaft and handle are in said locked position, said cog engages said socket and said shaft may not be rotated, and when said shaft and handle are in said unlocked position, said cog does not engage said socket and said shaft may be freely rotated within said socket.

2. An adjustable grip of a hand-held tool according to claim 1, wherein said spring comprises a coil spring disposed around said shaft and is compressed between said shaft and said socket.

3. An adjustable grip of a hand-held tool according to claim 2, said shaft comprising a first flange and said socket comprising a second flange, said spring being compressed between said first and second flanges to bias said shaft into said locked position.

4. An adjustable grip of a hand-held tool according to claim 1, further comprising:

a first set of teeth formed on said cog; and a second set of teeth formed on an inner surface of said socket, wherein said first and second teeth are meshingly engaged when said shaft is in said locked position and are not meshingly engaged when said shaft is in said unlocked position.

5. An adjustable grip of a hand-held tool according to claim 4, said first set of teeth being formed on a first end of said cog and said second set of teeth being formed on a first end of said socket, wherein when said shaft is in said locked position, said first end of said cog is aligned with said first end of said socket and when said shaft is in said unlocked position, said first end of said cog is not aligned with said first end of said socket.

6. An adjustable grip of a hand-held tool according to claim 5, wherein, when said shaft is in said locked position, said first and second sets of teeth are selectively engageable in one of a plurality of meshing configurations.

7. An adjustable grip of a hand-held tool according to claim 6, wherein each of said meshing configurations disposes said shaft in a different rotational position with respect to the housing.

8. An adjustable grip of a hand-held tool according to claim 4, wherein said socket and said cog are tapered in profile and said cog is disposed in at least a partially nested configuration within said socket.

9. An adjustable grip of a hand-held tool according to claim 1, wherein said socket and said cog are tapered in profile.

10. An adjustable grip of a hand-held tool according to claim 1, said clutch mechanism further comprising:

a first friction element attached to said handle;

a second friction element attached to a housing of the tool; and biasing means for biasing said friction elements together, wherein when said handle is in said locked position, said first friction element engages said second friction element and said handle may not be rotated, and when said handle is in said unlocked position, said first friction element does not engage said second friction element and said shaft may be freely rotated within said socket.

11. An adjustable grip of a hand-held tool according to claim 10, wherein said friction elements are one of disc-shaped, plate-shaped, and cone-shaped.

12. An adjustable grip of a hand-held tool according to claim 10, further comprising:

a socket formed through the housing;

a shaft, rotatably disposed through said socket, said handle disposed on a first end of said shaft, wherein said first friction element is attached to said shaft, said second friction element is attached to said housing at said socket, and said friction elements are selectively disposable in one of a continuous range of positions, thereby enabling said handle to be selectively disposable in one of a continuous range of positions with respect to the housing.

13. A hand-held tool having an adjustable grip, comprising:

a housing;

a handle selectively attached to said housing rotatably moveable from a locked position to an unlocked position;

a bearing surface of sufficient rigidity to carry bearing pressure from said hand-held tool to a receiving surface to be worked by said hand-held tool such that friction is created between said bearing surface and the receiving surface for said tool to perform its function on the receiving surface; and a clutch mechanism engageable with said handle when said handle is in said locked position and disengageable with said handle by direct application of axial force to said handle, wherein said clutch mechanism prevents said handle from being repositioned relative to said housing when said handle is in said locked position and allows said handle to be repositioned relative to said housing when said handle is in said unlocked position.

14. A hand-held tool having an adjustable grip according to claim 13, wherein said clutch mechanism biases said handle into said locked position.

15. A hand-held tool having an adjustable grip according to claim 13, said clutch mechanism comprising:

a socket formed through said housing;

a shaft, rotatably disposed through said socket, said handle disposed on a first end of said shaft;

a cog, selectively engageable with said socket, disposed on a second end of said shaft, wherein when said shaft and handle are in said locked position, said cog engages said socket and said shaft may not be rotated, and when said shaft and handle are in said unlocked position, said cog does not engage said socket and said shaft may be freely rotated within said socket.

16. A hand-held tool having an adjustable grip according to claim 15, further comprising a spring in contact with said shaft, said spring biasing said shaft and handle axially into said locked position.

17. A hand-held tool having an adjustable grip according to claim 16, wherein said spring comprises a coil spring disposed around said shaft and is compressed between said shaft and said socket.

18. A hand-held tool having an adjustable grip according to claim 17, said shaft comprising a first flange and said socket comprising a second flange, said spring being compressed between said first and second flanges to bias said shaft into said locked position.

19. A hand-held tool having an adjustable grip according to claim 15, further comprising:

a first set of teeth formed on said cog; and a second set of teeth formed on an inner surface of said socket, wherein said first and second teeth are meshingly engaged when said shaft is in said locked position and are not meshingly engaged when said shaft is in said unlocked position.

20. A hand-held tool having an adjustable grip according to claim 19, wherein said socket and said cog are tapered in profile and said cog is disposed in at least a partially nested configuration within said socket.

21. A hand-held tool having an adjustable grip according to claim 19, said first set of teeth being formed on a first end of said cog and said second set of teeth being formed on a first end of said socket, wherein when said shaft is in said locked position, said first end of said cog is aligned with said first end of said socket and when said shaft is in said unlocked position, said first end of said cog is not aligned with said first end of said socket.

22. A hand-held tool having an adjustable grip according to claim 19, wherein, when said shaft is in said locked position, said first and second sets of teeth are selectively engageable in one of a plurality of meshing configurations.

23. A hand-held tool having an adjustable grip according to claim 22, wherein said hand-held tool comprises one of a waxer-buffer, an orbital sander, and a router.

24. A hand-held tool having an adjustable grip according to claim 22, wherein each of said meshing configurations disposes said shaft in a different rotational position with respect to said housing.

25. A hand-held tool having an adjustable grip according to claim 15, wherein said socket and said cog are tapered in profile.

26. A hand-held tool having an adjustable grip according to claim 13, wherein said hand-held tool comprises one of a waxer-buffer, an orbital sander, and a router.

27. A hand-held tool having an adjustable grip according to claim 13, said clutch mechanism comprising:

a socket formed through said housing; and a shaft, rotatably disposed through said socket and moveable between a locked position and an unlocked position, having a first end projecting into an interior portion of said housing, said first end of said shaft having a first set of teeth disposed thereon, said first set of teeth selectively engageable with said socket, wherein when said shaft is in said locked position, said first set of teeth engages said socket and said shaft may not be rotated, and when said shaft is in said unlocked position, said first set of teeth does not engage said socket and said shaft may be freely rotated within said socket.

28. A hand-held tool having an adjustable grip according to claim 27, wherein, when said shaft is in said locked position, said first and second sets of teeth are selectively engageable in one of a plurality of meshing configurations.

29. A hand-held tool having an adjustable grip according to claim 28, wherein each of said meshing configurations disposes said shaft in a different rotational position with respect to said housing.

30. A hand-held tool having an adjustable grip according to claim 27, further comprising a spring in contact with said shaft, said spring biasing said shaft axially into said locked position.

31. A hand-held tool having an adjustable grip according to claim 30, wherein said spring comprises a coil spring disposed around said shaft and is compressed between said shaft and socket.

32. A hand-held tool having an adjustable grip according to claim 31, said shaft comprising a first flange and said socket comprising a second flange, said spring being compressed between said first and second flanges to bias said shaft into said locked position.

33. A hand-held tool having an adjustable grip according to claim 13, said clutch mechanism further comprising:

a first friction element attached to said handle;

a second friction element attached to a housing of the tool; and biasing means for biasing said friction elements together, wherein when said handle is in said locked position, said first friction element engages said second friction element and said handle may not be rotated, and when said handle is in said unlocked position, said first friction element does not engage said second friction element and said shaft may be freely rotated within said socket.

34. An adjustable grip for a hand-held tool according to claim 33, wherein said friction elements are one of disc-shaped, plate-shaped, and cone-shaped.

35. An adjustable grip for a hand-held tool according to claim 33, further comprising:

a socket formed through the housing;

a shaft, rotatably disposed through said socket, said handle disposed on a first end of said shaft, wherein said first friction element is attached to said shaft, said second friction element is attached to said housing at said socket, and said friction elements are selectively disposable in one of a continuous range of positions, thereby enabling said handle to be selectively disposable in one of a continuous range of positions with respect to the housing.

* * * * *